US009141044B2

(12) United States Patent
Satomi

(10) Patent No.: US 9,141,044 B2
(45) Date of Patent: Sep. 22, 2015

(54) FIXING APPARATUS WITH MOVABLE MAGNETIC FLUX SHIELDING PORTION AND SHEET GUIDE PORTION, AND IMAGE FORMING APPARATUS

(71) Applicant: CANON KABUSHIKI KAISHA, Tokyo (JP)

(72) Inventor: Yoshiyasu Satomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/012,471

(22) Filed: Aug. 28, 2013

(65) Prior Publication Data

US 2014/0064762 A1 Mar. 6, 2014

(30) Foreign Application Priority Data

Sep. 4, 2012 (JP) ..... 2012-193668

(51) Int. Cl.
*G03G 15/20* (2006.01)

(52) U.S. Cl.
CPC ..... *G03G 15/2017* (2013.01); *G03G 15/2028* (2013.01); *G03G 15/2042* (2013.01); *G03G 2215/0132* (2013.01); *G03G 2215/2035* (2013.01)

(58) Field of Classification Search
CPC ..... G03G 15/2028; G03G 15/2042
USPC ..... 399/322, 337
See application file for complete search history.

(56) References Cited

U.S. PATENT DOCUMENTS 7,099,616 B2 8/2006 Kato et al.
7,197,270 B2 3/2007 Kato et al.
7,268,326 B2 9/2007 Yamamoto et al.
8,229,339 B2 7/2012 Nanjo
2004/0253027 A1 12/2004 Kato et al.
2006/0086724 A1 4/2006 Yamamoto et al.
2006/0204292 A1 9/2006 Kato et al.
2010/0067929 A1* 3/2010 Seki ..... 399/45
2010/0272482 A1 10/2010 Nanjo
2013/0058673 A1* 3/2013 Kikkawa ..... 399/69

FOREIGN PATENT DOCUMENTS

CN 1573607 A 2/2005
CN 101872148 A 10/2010

(Continued)

OTHER PUBLICATIONS

Chinese Office Action dated Jul. 2, 2015, in counterpart Chinese Application No. 201310385158.0.

*Primary Examiner* — Clayton E Laballe
*Assistant Examiner* — Peter L Cheng
(74) *Attorney, Agent, or Firm* — Fitzpatrick, Cella, Harper & Scinto

(57) ABSTRACT

A fixing apparatus includes a fixing portion which comes into contact with a sheet and fixes a toner image on the sheet, a magnetic flux generating portion which generates a magnetic flux so as to heat the fixing portion by electromagnetic induction, a magnetic flux shielding portion which shields a magnetic flux generated from the magnetic flux generating portion between the fixing portion and the magnetic flux generating portion, a support portion which supports the magnetic flux shielding portion, a moving portion which moves the support portion in a width direction perpendicular to a sheet conveying direction, a controller which controls the moving portion so as to move the magnetic flux shielding portion to a position based on a sheet size in the width direction, and a sheet guide portion which is supported on the support portion and guides the sheet to the fixing portion.

24 Claims, 10 Drawing Sheets

(56) References Cited

FOREIGN PATENT DOCUMENTS

| | | | | | |
|---|---|---|---|---|---|
| JP | 2006-267180 A | | 10/2006 | | |
| JP | 2008-014966 | * | 1/2008 | ..... | G03G 15/20 |
| JP | 4396558 B2 | | 1/2010 | | |
| JP | 2013-050518 | * | 3/2013 | ..... | G03G 15/20 |

* cited by examiner

FIXING APPARATUS WITH MOVABLE MAGNETIC FLUX SHIELDING PORTION AND SHEET GUIDE PORTION, AND IMAGE FORMING APPARATUS

BACKGROUND OF THE INVENTION

1. Field of the Invention

The present invention relates to a fixing apparatus which fixes a toner image by heating the toner image formed on a sheet, and an image forming apparatus including the same.

2. Description of the Related Art

A copying machine, a printer, or a facsimile, which performs image formation by an electrophotographic system, an electrostatic recording system, or the like, or an image forming apparatus having multiple functions thereof is mounted with a fixing apparatus which fixes a toner image formed on a sheet.

As a heating portion which heats a fixing rotating member of a fixing apparatus, there has been proposed an electromagnetic induction heating portion which generates heat by Joule heat by generating an eddy current in an induction heating member provided in a fixing rotating member by an exciting coil. When small-size sheets are heated in succession, the following problems occur. That is, in a region (sheet passing region) where a sheet contacts a surface of a fixing rotating member, the sheet is conveyed while heat is being transferred to the sheet. In contrast, in a region (sheet non-passing region) where the sheet does not contact the surface of the fixing rotating member, no heat is transferred to the sheet. Thus, heat is accumulated in the fixing rotating member, causing an excessive temperature rise. Therefore, a great temperature difference occurs between the sheet passing region and the sheet non-passing region in the fixing rotating member.

Japanese Patent Laid-Open No. 2006-267180 discloses a technique which adjusts a temperature of a sheet non-passing region in a fixing rotating member by inserting or removing a magnetic shielding plate in a gap portion between a fixing rotating member having an electromagnetic induction heat generating layer and an exciting coil which generates a magnetic flux. That is, when there is a risk of the excessive temperature rise in the sheet non-passing region by conveying a small-size sheet, the arrival of the magnetic flux at the fixing rotating member is blocked by inserting the magnetic shielding plate into the gap portion, and the heat generation of the fixing rotating member in the sheet non-passing region is suppressed.

Meanwhile, when conveying a large-size sheet, the magnetic shielding plate is moved to the outside of the gap portion, and the entire area of the fixing rotating member generates heat. The magnetic shielding plate is made of a material having high permeability and high electrical resistance (for example, ferrite). Since the material having high electrical resistance is used, a current value becomes small, and thus, heat generation of the magnetic shielding plate itself is suppressed.

As disclosed in Japanese Patent Laid-Open No. 2006-267180, in the configuration including the movable magnetic shielding plate, when the magnetic shielding plate is disposed at a position which is an upstream side in a sheet conveying direction rather than a fixing nip portion of a fixing apparatus and is in vicinity of the fixing nip portion, a space is required for disposing the magnetic shielding plate at a position which is an upstream side of the fixing nip portion and is in the vicinity of the fixing nip portion.

Meanwhile, in many cases, the sheet being conveyed to the fixing nip portion is curled. Therefore, a sheet conveying guide is disposed for certainly conveying the sheet to the fixing nip portion. Even though the magnetic shielding plate intends to be disposed at the position which is the upstream side in the sheet conveying direction rather than the fixing nip portion and is in the vicinity of the fixing nip portion, the magnetic shielding plate may not be disposed due to the sheet conveying guide, or the shape of the magnetic shielding plate is restricted. Thus, the magnetic shielding function may not be sufficiently exhibited.

The present invention is for solving the above-described problems, and in a fixing apparatus including a magnetic flux shielding portion which shields a magnetic flux generated from an electromagnetic induction heating portion, it is desirable to provide a fixing apparatus which can have both functions of a magnetic flux shielding portion and a sheet conveying guide.

SUMMARY OF THE INVENTION

According to the present invention, a typical fixing apparatus which fixes a toner image on a sheet by heating the toner formed on the sheet includes a fixing portion which comes into contact with a sheet and fixes a toner image on the sheet, a magnetic flux generating portion which generates a magnetic flux so as to heat the fixing portion by electromagnetic induction, a magnetic flux shielding portion which shields a magnetic flux generated from the magnetic flux generating portion between the fixing portion and the magnetic flux generating portion, a support portion which supports the magnetic flux shielding portion, a moving portion which moves the support portion in a width direction perpendicular to a sheet conveying direction, a controller which controls the moving portion so as to move the magnetic flux shielding portion to a position based on a sheet size in the width direction, and a sheet guide portion which is supported to the support portion and guides the sheet to the fixing portion.

Further features of the present invention will become apparent from the following description of exemplary embodiments with reference to the attached drawings.

DESCRIPTION OF THE EMBODIMENTS

An embodiment of an image forming apparatus equipped with a fixing apparatus according to the present invention will be described below in detail with reference to the drawings. Also, embodiment set forth below are exemplary embodiments of the present invention, and the present invention is not limited to these embodiments.

Figure 1:
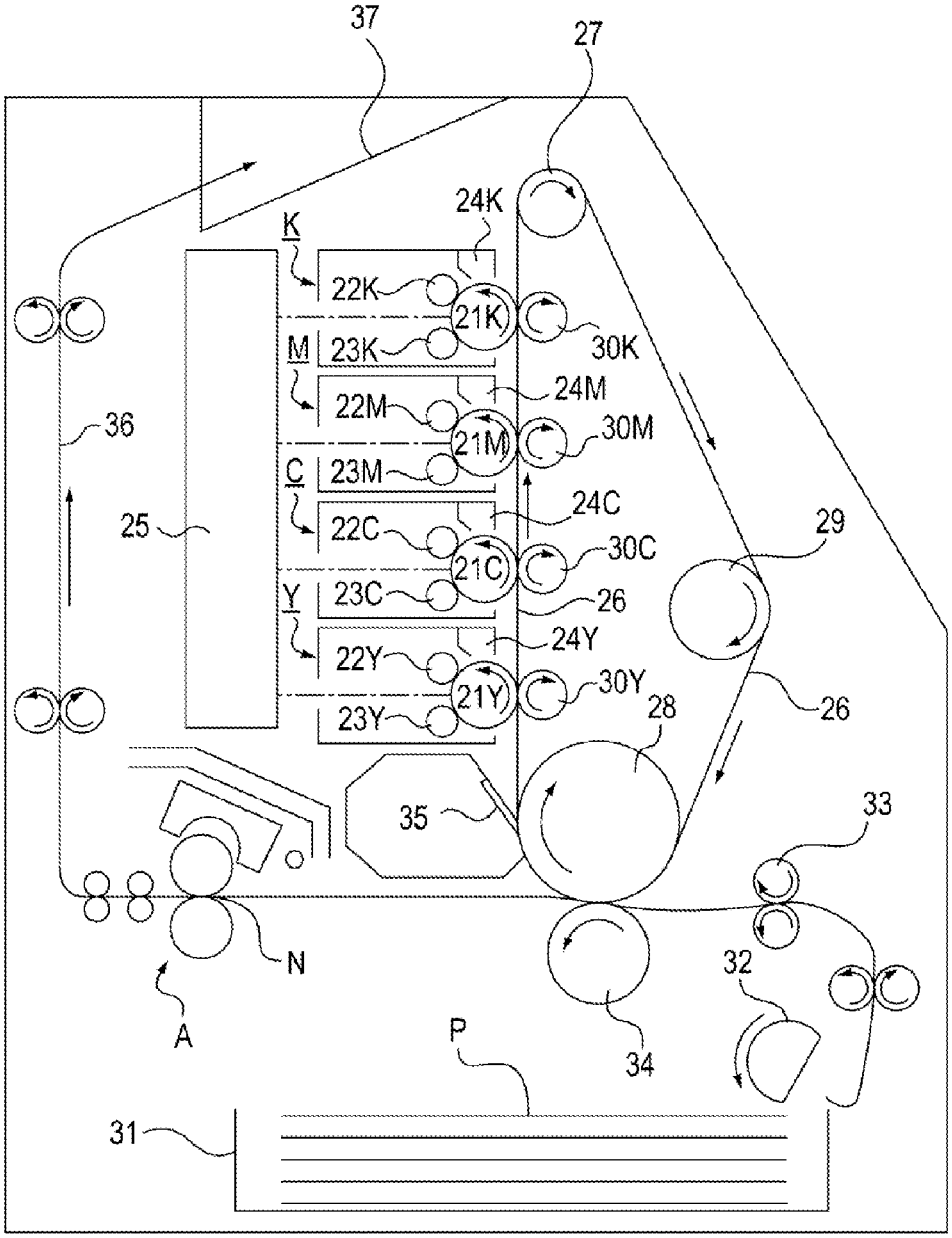
FIG. 1 is a cross-sectional illustration diagram illustrating a configuration of an image forming apparatus equipped with a fixing apparatus according to an embodiment of the present invention.

<Image Forming Apparatus> An image forming apparatus of the present embodiment illustrated in FIG. 1 is an example of a color image forming apparatus using an electrophotographic system.

In FIG. 1, four image forming units Y, C, M and K form color toner images of yellow, cyan, magenta, and black, respectively, and are arranged in this order from bottom to top in FIG. 1.

The image forming units Y, C, M and K include photosensitive drums 21Y, 21C, 21M and 21K serving as image bearing members, and charging devices 22Y, 22C, 22M and 22K serving as charging portions, respectively. Also, the image forming units Y, C, M and K include development devices 23Y, 23C, 23M and 23K serving as development portions, and cleaning devices 24Y, 24C, 24M and 24K serving as cleaning portions, respectively.

Also, for convenience of description, a photosensitive drum 21 may be described on behalf of the photosensitive drums 21Y, 21C, 21M and 21K. Components constituting other image forming units will be described in a similar manner.

Yellow toner is received in the development device 23Y of the yellow image forming unit Y. Cyan toner is received in the development device 23C of the cyan image forming unit C. Magenta toner is received in the development device 23M of the magenta image forming unit M. Black toner is received in the development device 23K of the black image forming unit K.

A laser exposure device 25 is provided corresponding to the four-color image forming units Y, C, M and K. By performing scanning exposure on the respective photosensitive drums 21, whose surfaces are uniformly charged by the charging devices 22, by laser beams emitted from the laser exposure device 25 according to image information, electrostatic latent images corresponding to scanning exposure image patterns of the respective colors are formed on the surfaces of the respective photosensitive drums 21.

The respective color toners are supplied by the development devices 23 for the respective colors, and the electrostatic latent images formed on the surfaces of the respective photosensitive drums 21 are developed as toner images. That is, a yellow toner image is formed in the photosensitive drum 21Y of the yellow image forming unit Y. A cyan toner image is formed in the photosensitive drum 21C of the cyan image forming unit C. A magenta toner image is formed in the photosensitive drum 21M of the magenta image forming unit M. A black toner image is formed in the photosensitive drum 21K of the black image forming unit K.

The respective color toner images formed on the photosensitive drums 21 of the respective image forming units Y, C, M and K are primarily transferred in a sequentially superimposed manner in a state of being aligned on an outer circumferential surface of an intermediate transfer belt 26 which rotates substantially at the same velocity in synchronization with the rotation of the respective photosensitive drums 21. In this manner, unfixed full-color toner images are synthetically formed on the intermediate transfer belt 26.

The intermediate transfer belt 26 is stretched by three rollers, that is, a driving roller 27, a secondary-transfer-roller counter roller 28, and a tension roller 29, and is driven to rotate by the rotation driving of the driving roller 27.

As a primary transferring portion of the toner images from the top of the photosensitive drums 21 of the respective image forming units Y, C, M and K to the top of the intermediate transfer belt 26, a primary transfer roller 30 provided to face the respective photosensitive drums 21 in the inner circumferential surface side of the intermediate transfer belt 26 is used. A primary transfer bias voltage having an opposite polarity to the toner is applied to the primary transfer roller 30 by a bias power supply which is not illustrated. In this manner, the toner images are primarily transferred from the top of the photosensitive drums 21 of the respective image forming units Y, C, M and K to the intermediate transfer belt 26. In the respective image forming units Y, C, M and K, after the primary transfer from the top of the photosensitive drums 21 to the intermediate transfer belt 26, the toner remaining on the photosensitive drums 21 is scraped and removed by the cleaning device 24.

The image forming operation is performed on the respective colors of yellow, magenta, cyan, and black in synchronization with the rotation of the intermediate transfer belt 26. The primarily transferred toner images of the respective colors are formed on the intermediate transfer belt 26 in a sequentially superimposed manner. Also, in a monochromatic image formation (monochromatic mode), the image forming process is performed on only a target color.

Meanwhile, a sheet P received in a sheet cassette 31 is sent by a feed roller 32 and is separately fed one by one by a separating portion which is not illustrated. Subsequently, the sheet P is conveyed by a registration roller 33 at a predetermined timing to the intermediate transfer belt 26, which is wound around the secondary-transfer-roller counter roller 28, and a transfer nip portion, which is formed by a secondary transfer roller 34.

The toner image formed on the outer circumferential surface of the intermediate transfer belt 26 is transferred to the top of the sheet P in a lump by the transfer bias voltage having an opposite polarity to the toner applied to the secondary transfer roller 34, the transfer bias voltage being applied by the bias power supply which is not illustrated. The image forming portion forming unfixed toner images on the sheet P is configured by the image forming units Y, C, M and K, the intermediate transfer belt 26, and the secondary transfer roller 34. The toner remaining on the outer circumferential surface of the intermediate transfer belt 26 after the secondary transfer is scraped and removed by the cleaning device 35.

The sheet P, on which the toner image is transferred, is conveyed toward the fixing apparatus A by a belt conveying portion. The unfixed toner image T formed on the sheet P (on the sheet) by the secondary transfer is heated and pressurized by the fixing apparatus A and is then fixed on the sheet P. Then, as a full-color printing, the sheet P is discharged to a discharge tray 37 through a discharge path 36.

Figure 2:
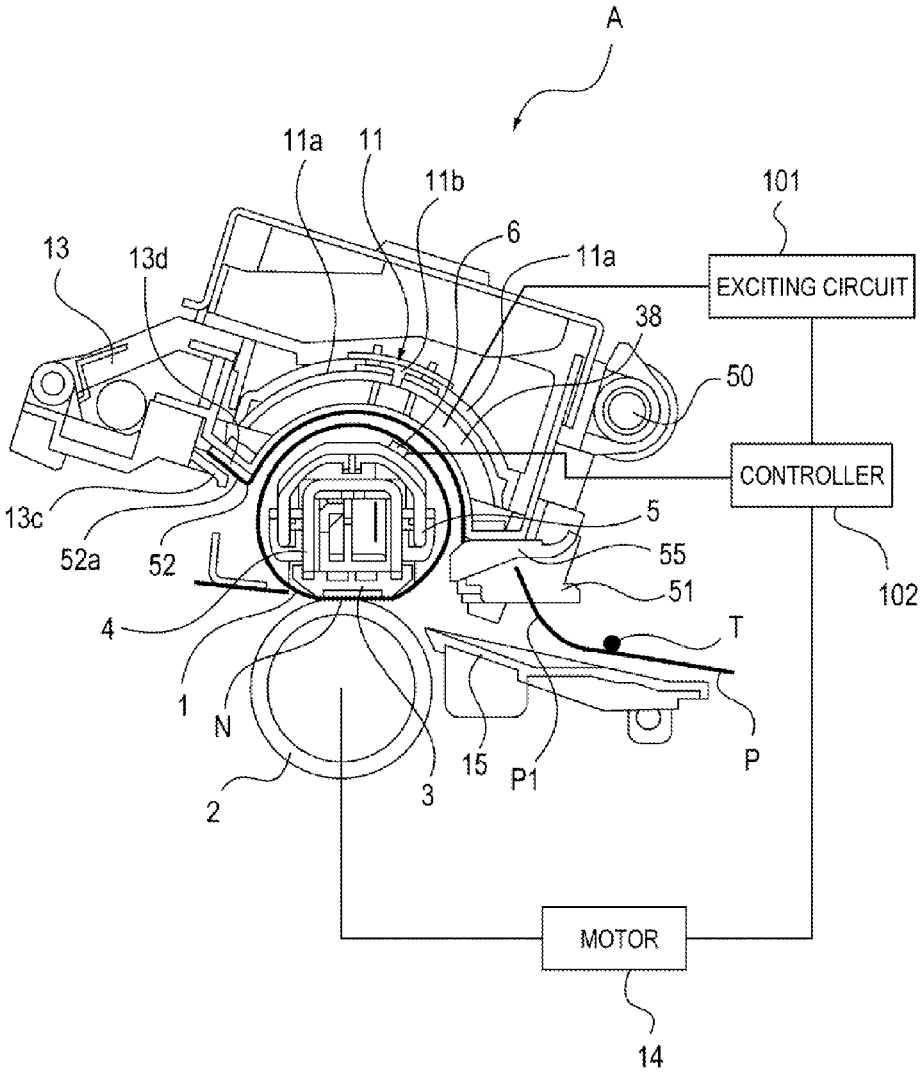
FIG. 2 is a cross-sectional illustration diagram illustrating a configuration of the fixing apparatus according to the embodiment of the present invention and a block diagram illustrating a configuration of a control system.

<Fixing apparatus> A configuration of the fixing apparatus A will be described below with reference to FIG. 2. FIG. 2 is a cross-sectional illustration diagram illustrating a configuration of a fixing apparatus A according to an embodiment of the present invention and a block diagram illustrating a configuration of a control system.

In FIG. 2, an endless fixing belt 1 has a metal layer serving as a fixing portion to be disposed in the unfixed toner image T surface side (unfixed toner image surface side) formed on the sheet P. A pressure roller 2 is disposed to face the fixing belt 1 and is a pressurization rotating member serving as a pressurizing portion which rotates while abutting against the outer circumferential surface of the fixing belt 1.

A pressure applying member 3 forms a fixing nip portion N by applying a pressing force between the fixing belt 1 and the pressure roller 2. The pressure applying member 3 is held to a metal stay 4.

An exciting coil 38 is disposed to face the fixing belt 1 in an opposite side to the pressure roller 2. The exciting coil 38 as a heating portion heats a metal layer, which is embedded in the fixing belt 1, by electromagnetic induction. Also, the heating by the electromagnetic induction refers to heating by Joule heat generated when a current flows around the metal layer (conductive layer) embedded in the fixing belt 1, depending on a variation in a magnetic field in the metal layer (conductive layer) when giving a variation to the magnetic field generated by a high-frequency wave applied to the exciting coil 38 as a magnetic flux generating portion.

Also, a magnetic flux shielding core 5, which shields the magnetic flux generated from the exciting coil 38, is provided in the exciting coil 38 side of the stay 4. The magnetic flux shielding core 5 prevents a temperature of the fixing belt 1 from rising due to induction heating.

For example, the exciting coil 38 of the present embodiment uses a Litz wire as an electric wire. The Litz wire is made of enamel twisted wire having good high-frequency characteristic because a resistance increase due to a skin effect is small when a high-frequency wave passes through an electric wire. The exciting coil 38 made by winding the electric wire is formed in a shape of a ship bottom which is horizontally long, and is disposed to partially face a circumferential surface and a side surface of the fixing belt 1.

The fixing apparatus A includes an outer magnetic core 11 and a coil holding member 13. The outer magnetic core 11 covers the exciting coil 38 so as to substantially prevent leakage of the magnetic field generated by the exciting coil 38, except for the metal layer (conductive layer) of the fixing belt 1, and the coil holding member 13 supports them by a resin having an insulating property.

In the upper side of the outer circumferential surface of the fixing belt 1 in FIG. 2, the exciting coil 38 is disposed to face the fixing belt 1 with a predetermined gap (clearance).

Figure 3:
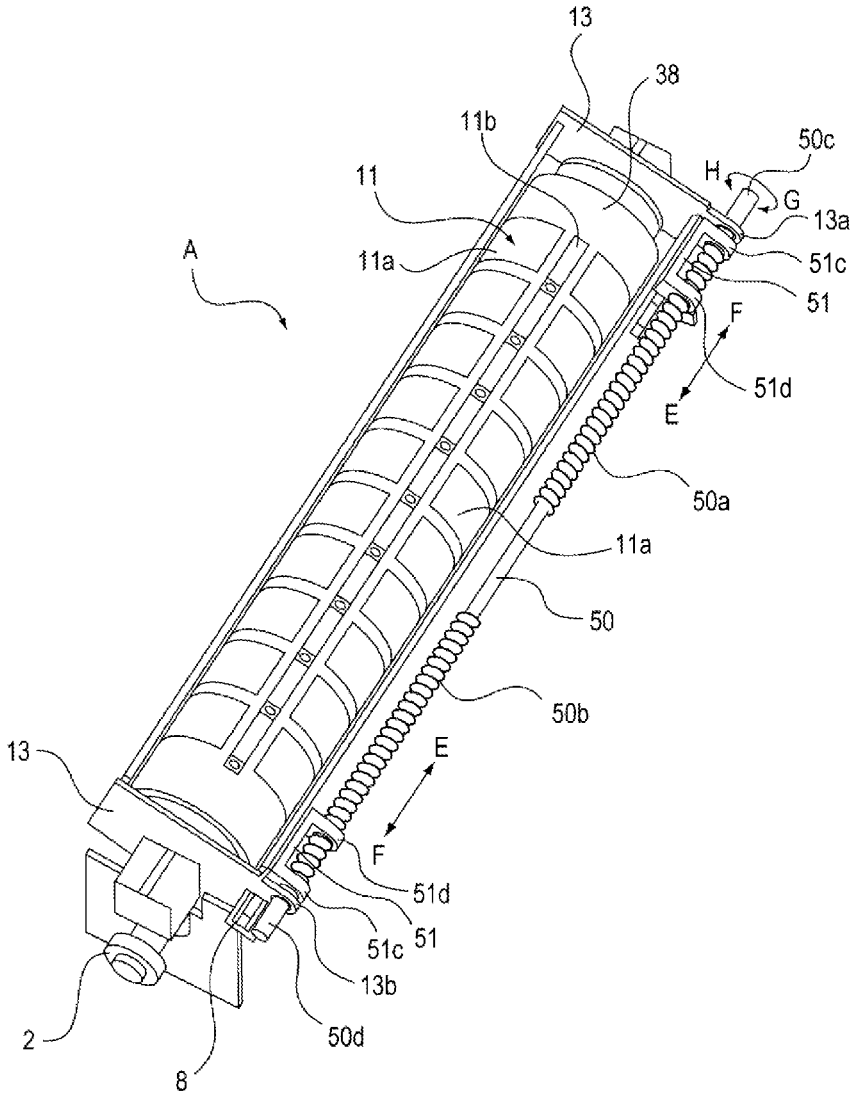
FIG. 3 is a perspective illustration diagram illustrating a configuration of the fixing apparatus according to the embodiment of the present invention in which a magnetic flux shielding member and a sheet guide member are not shown.

As illustrated in FIG. 3, in the present embodiment, the outer magnetic core 11 is separately provided with a core 11*a* and a core 11*b*. Also, the core 11*a* and the core 11*b* can also be integrally provided without being separated from each other. In the present embodiment, as illustrated in FIG. 3, each of the core 11*a* and the core 11*b* in the outer magnetic core 11 is separately disposed in a longitudinal direction of the fixing apparatus A.

In a rotating state of the fixing belt 1, a high-frequency current of 20 kHz to 60 kHz is applied from an exciting circuit 101 serving as a power supply to the exciting coil 38. The metal layer (conductive layer) of the fixing belt 1 is inductively heated by an alternating magnetic field generated by the exciting coil 38 (magnetic field whose magnitude and direction are repetitively changed with time).

In FIG. 2, the fixing apparatus A includes a temperature sensor such as, for example, a thermistor. The temperature sensor 6 is disposed to abut against the fixing belt 1 at a position of a central inner surface portion of the fixing belt 1 in a direction perpendicular to a conveying direction of the sheet P (hereinafter, referred to as a "sheet width direction").

The temperature sensor 6 detects a temperature of the fixing belt 1 in a passing region of the sheet P, and feeds the detection information back to a controller 102. The controller 102 controls power input from the exciting circuit 101 to the exciting coil 38, such that the temperature of the fixing belt 1 detected by the temperature sensor 6 is maintained at a predetermined target temperature (fixing temperature).

That is, when the temperature of the fixing belt 1 detected by the temperature sensor 6 rises to a predetermined temperature, current carrying to the exciting coil 38 is controlled. In the present embodiment, in order to constantly maintain the temperature of the fixing belt 1 at 180° C., which is the target temperature (fixing temperature), the controller 102 performs temperature regulation by controlling the exciting circuit 101, based on a detection value of the temperature sensor 6, and controlling power input to the exciting coil 38 while changing a frequency of a high-frequency current.

The temperature sensor 6 of the present embodiment is attached to the pressure applying member 3 through an elastic support member. Even when a position variation such as a rippling of the abutting surface with respect to the temperature sensor 6 of the fixing belt 1 occurs, the temperature sensor 6 is configured to follow this and maintain a good contact state.

In at least the image forming operation, the pressure roller 2 is driven to rotate by a motor 14 serving as a driving source controlled by the controller 102. The fixing belt 1 as a fixing rotating member is rotated by the pressure roller 2. The pressure roller 2 and the fixing belt 1 are driven to rotate at substantially the same circumferential velocity as the conveying velocity of the sheet P bearing the unfixed toner image T conveyed from the transfer nip portions of the intermediate transfer belt 26 stretched in the secondary-transfer-roller counter roller 28 and the secondary transfer roller 34.

In the case of the present embodiment, the outer circumferential surface of the fixing belt 1 can be rotated at a rotating velocity of 200 mm/sec, and the full-color toner image can be fixed on fifty A4-size (210 mm×297 mm) sheet P per minute and can be fixed on thirty-two A4R-size sheet P per minute. The A4R-size sheet P refers to a case where the sheet P is conveyed while arranging a longitudinal direction (297 mm) of the A4-size sheet P in a sheet width direction.

Figure 4:
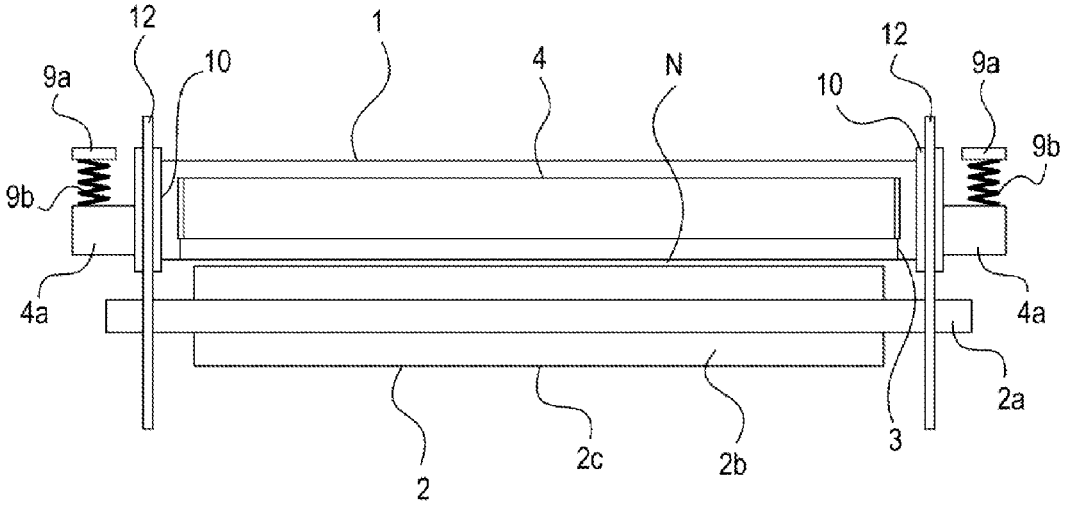
FIG. 4 is a cross-sectional illustration diagram illustrating a configuration of the fixing apparatus according to the embodiment of the present invention.

Next, the configuration of the fixing nip portion N formed by the fixing belt 1 and the pressure roller 2 of the fixing apparatus A will be described with reference to FIG. 4. In FIG. 4, fixing flanges 10 are restricting members which restrict a left/right movement of the fixing belt 1 in a longitudinal direction and also restrict a shape of the fixing belt 1 in a circumferential direction.

A pressure spring 9*b* is disposed in a contracted state between both ends 4*a* of the stay 4 provided to pass through the left and right fixing flanges 10 and a receiving member 9*a* provided in a device frame which is not illustrated. Therefore, a force which presses the stay 4 downward in FIG. 4 is applied by a pressing force of the pressure spring 9*b*. Therefore, a lower surface of the stay 4 and an upper surface of the pressure roller 2 are pressed, with the fixing belt 1 being disposed therebetween, to form the fixing nip portion N having a predetermined width.

Next, the fixing operation by the fixing apparatus A will be described with reference to FIG. 2. The exciting coil 38 is supplied with power from the exciting circuit 101 controlled by the controller 102, and the temperature of the fixing belt 1 is regulated to a predetermined fixing temperature. In that state, the sheet P where the unfixed toner image T is formed on the surface between the fixing belt 1 and the pressure roller 2 in the fixing nip portion N is guided by sheet guide members 15 and 55 and introduced into the fixing nip portion N, while the unfixed toner image T side is directed toward the fixing belt 1 side.

In the vicinity of the fixing nip portion N formed by the fixing belt 1 and the pressure roller 2, the sheet guide member 55 is disposed in an upstream side in the sheet conveying direction (right side of FIG. 2) rather than the fixing nip portion N.

The sheet P comes into close contact with the outer circumferential surface of the fixing belt 1 in the fixing nip portion N, and the sheet P is cramped by the fixing belt 1 and the pressure roller 2 and is conveyed by the fixing nip portion N. Therefore, the heat of the fixing belt 1 is applied to the unfixed toner image T on the sheet P, and the unfixed toner image T receives the pressing force of the fixing nip portion N and is hot-pressed and fixed on the surface of the sheet P. Due to surface deformation of the fixing belt 1 in an outlet portion of the fixing nip portion N, the sheet P passing through the fixing nip portion N is separated from the outer circumferential surface of the fixing belt 1 and is conveyed to the outside of the fixing apparatus A.

Figure 5:
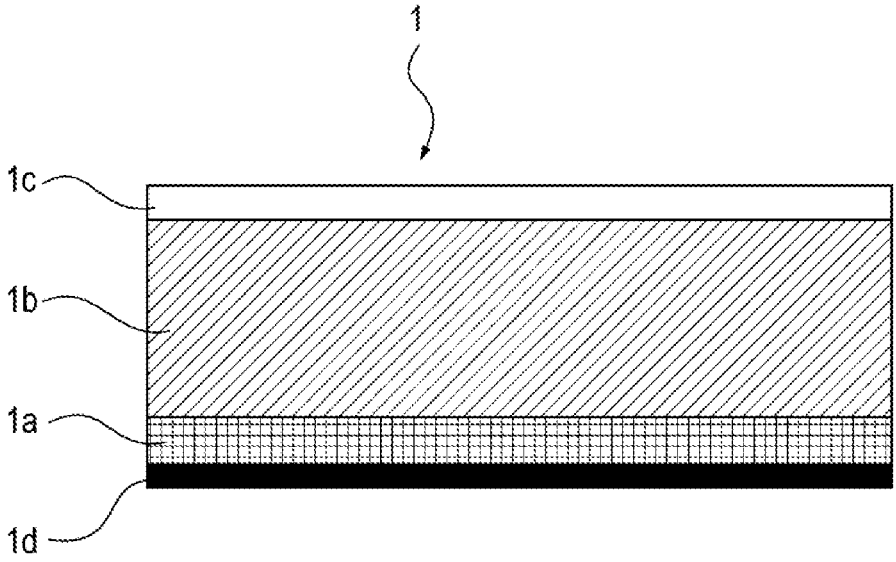
FIG. 5 is a cross-sectional illustration diagram illustrating a configuration of a fixing member.

<Fixing Belt> FIG. 5 is a model illustration diagram illustrating a layer configuration of the fixing belt 1. The fixing belt 1 includes a base layer 1*a* made of a metal layer having an inner diameter of about 20 mm to 40 mm.

An elastic layer 1*b* made of a heat-resisting rubber layer is provided in an outer circumference of the base layer 1*a*. A thickness of the elastic layer 1*b* can be set in a range of 100 μm to 1,000 μm. In the present embodiment, warming-up time is shortened by reducing heat capacity of the fixing belt 1, and a thickness of the elastic layer 1*b* is set to 1,000 μm, taking into consideration that appropriate fixing images are obtained when color images are fixed. Also, a surface toner parting layer 1*c* made of a fluorine resin layer is provided in the outer circumference of the elastic layer 1*b*. The surface toner parting layer 1*c* is made of, for example, tetrafluoroethylene-perfluoroalkyl ether copolymer (PFA) or polytetrafluoroethylene (PTFE).

In the inner surface side of the base layer 1*a*, a slipping layer 1*d*, which has good sliding property and has a thickness of about 10 μm to 50 μm, may be provided for reducing sliding friction of the inner circumferential surface of the fixing belt 1 and the temperature sensor 6.

Also, for the base layer 1*a* of the fixing belt 1 which is made of the metal layer, a metal such as an iron alloy, copper, or silver may be appropriately selected.

<Pressure Roller> As illustrated in FIG. 4, the pressure roller 2 which forms the fixing nip portion N between the pressure roller 2 and the fixing belt 1 is provided with an elastic layer 2*b* made of a rubber layer in an outer circumference of a metal core bar 2*a*. Also, a toner parting layer 2*c* is provided on an outer circumferential surface of an elastic layer 2*b*. The pressure roller 2 of the present embodiment has an outer diameter of 40 mm.

<Exciting Coil> The configuration of the exciting coil 38 in the present embodiment will be described with reference to FIG. 2. The fixing belt 1 and the exciting coil 38 are maintained in an electrically insulating state by a mold having a thickness of about 2 mm. The fixing belt 1 and the exciting coil 38 are disposed spaced apart from each other by a predetermined distance. Due to the alternating magnetic field generated by the exciting coil 38, the metal layer (conductive layer) provided in the base layer 1*a* of the fixing belt 1 is uniformly heated by induction heating.

A high-frequency current of 20 kHz to 60 kHz is applied to the exciting coil 38 by the exciting circuit 101. The metal layer (conductive layer) provided in the base layer 1*a* of the fixing belt 1 is inductively heated. In order to constantly maintain the temperature of the fixing belt 1 at 180° C., which is the target temperature (fixing temperature), the controller 102 changes a frequency of the high-frequency current of the exciting circuit 101, based on the detection value of the temperature sensor 6. Therefore, the temperature of the fixing belt 1 is regulated by controlling the power input to the exciting coil 38.

The exciting coil 38 is disposed in the outside of the fixing belt 1 which becomes high temperature. Therefore, the temperature of the exciting coil 38 hardly becomes high, and the electrical resistance thereof does not increase. Hence, even when the high-frequency current flows through the exciting coil 38, loss caused by Joule heat can be reduced. Also, the arrangement of the exciting coil 38 in the outside of the fixing belt 1 contributes to the diameter reduction and low heat capacity of the fixing belt 1, and improves energy-saving performance.

<Magnetic Flux Shielding Portion Corresponding to Sheet Size> As described above, in the conventional fixing apparatus, when small-size sheet P is heated in succession in a large amount, an excessive temperature rise occurs in a non-passing region of the sheet P. The following description will be given of a temperature control portion which controls a heat generation distribution in the longitudinal direction of the fixing apparatus A (width direction perpendicular to the sheet conveying direction) according to the sheet size of each sheet P to be used, depending on the temperature rise in the non-passing region of the sheet P.

FIGS. 6 and 7 are diagrams describing the configuration of the fixing apparatus A of the present embodiment. FIG. 8 is a perspective illustration diagram of essential parts illustrating a configuration of a moving portion which moves a slide member 51 in which a magnetic flux shielding member 52 and a sheet guide member 55 are integrally provided.

In the fixing apparatus A of the present embodiment, the sheet P is conveyed on a so-called center basis. That is, the sheet P is conveyed while matching the center of the sheet P in a width direction (direction perpendicular to the sheet conveying direction) with the center of the conveying path in a width direction. FIG. 6 is a diagram illustrating a case where a sheet P having a sheet width W1 of a maximum size passes through the fixing apparatus A. FIG. 7 is a diagram illustrating a case where a sheet P having a sheet width W2 of a minimum size passes through the fixing apparatus A.

The outer magnetic core 11 disposed in the longitudinal direction of the fixing apparatus A affects a heat generation width of the fixing belt 1. The outer magnetic core 11 is disposed to match the maximum width of the outer magnetic core 11 with the sheet width W1 of the maximum size so as to correspond to the sheet width W1 of the maximum size of the sheet P.

In the present embodiment, the magnetic flux shielding member 52 is provided to serve as a magnetic flux shielding portion which shields a magnetic flux generated from the exciting coil 38 according to each size of the sheet P to be used. The magnetic flux shielding member 52 may be made of a non-magnetic material, such as aluminum, copper, silver, gold, and brass, or an alloy thereof, and may be made of permalloy including ferrite or Fe—Ni alloy, whose main component is an iron oxide being a high-permeability member.

The magnetic flux shielding member 52 may be disposed between the fixing belt 1 and the magnetic flux shielding core 5, as well as between the exciting coil 38 and the fixing belt 1.

In the present embodiment, as illustrated in FIG. 8, a copper plate is used as the magnetic flux shielding member 52 and is movably inserted between the exciting coil 38 and the fixing belt 1 in the sheet width direction. Inserting the magnetic flux shielding member 52 made of the copper plate between the exciting coil 38 and the fixing belt 1 obtains an effect that the passing of the magnetic flux, which is formed by the exciting coil 38 and the outer magnetic core 11, through the metal layer (conductive layer) provided in the base layer 1*a* of the fixing belt 1 is weakened. Therefore, induction heating of the metal layer (conductive layer) is reduced.

As illustrated in FIGS. 3 and 8, a lead screw member 50 axially supported rotatably to bearing portions 13*a* and 13*b* is provided in the coil holding member 13 which is provided at both ends of the fixing apparatus A. The lead screw member 50 is disposed in a direction perpendicular to the sheet conveying direction, and male screw portions 50*a* and 50*b* of opposite directions are formed on the left and right sides thereof.

A pair of slide members 51 having a boss portion 51*b* constituting female screw portions respectively engaged with the male screw portions 50*a* and 50*b* of the lead screw member 50 are movably provided in a direction in which they become close to or far away from each other along the lead screw member 50.

The lead screw member 50 is driven to rotate by a motor 7 serving as a driving source controlled by a controller 103 illustrated in FIGS. 6 and 7. In this manner, the pair of slide members 51 are moved along the lead screw member 50 in a direction perpendicular to the sheet conveying direction in a direction in which they become close to or far away from each other.

As illustrated in FIG. 8, the magnetic flux shielding member 52 and the sheet guide member 55 are supported to the slide members 51 serving as support portions. In the width direction perpendicular to the sheet conveying direction, the sheet guide member 55 extends more inwardly towards the center of the sheet conveyance path, in a direction perpendicular to the sheet conveying direction, than the magnetic flux shielding member 52. The slide member 51 supporting the magnetic flux shielding member 52 and the sheet guide member 55 are supported to the lead screw member 50. That is, the magnetic flux shielding member 52 and the sheet guide member 55 are configured to move in a direction perpendicular to the sheet conveying direction integrally with the slide member 51, depending on the rotation of the lead screw member 50.

The lead screw member 50 or the motor 7 configures a moving portion which move the slide member 51 supporting the magnetic flux shielding member 52 and the sheet guide member 55 in a direction perpendicular to the sheet conveying direction. The moving portion moves the magnetic flux shielding member 52 and the sheet guide member 55 in the direction perpendicular to the sheet conveying direction according to the size width of the direction perpendicular to the sheet conveying direction of the sheet P to be used.

Figures 6A, 6B:
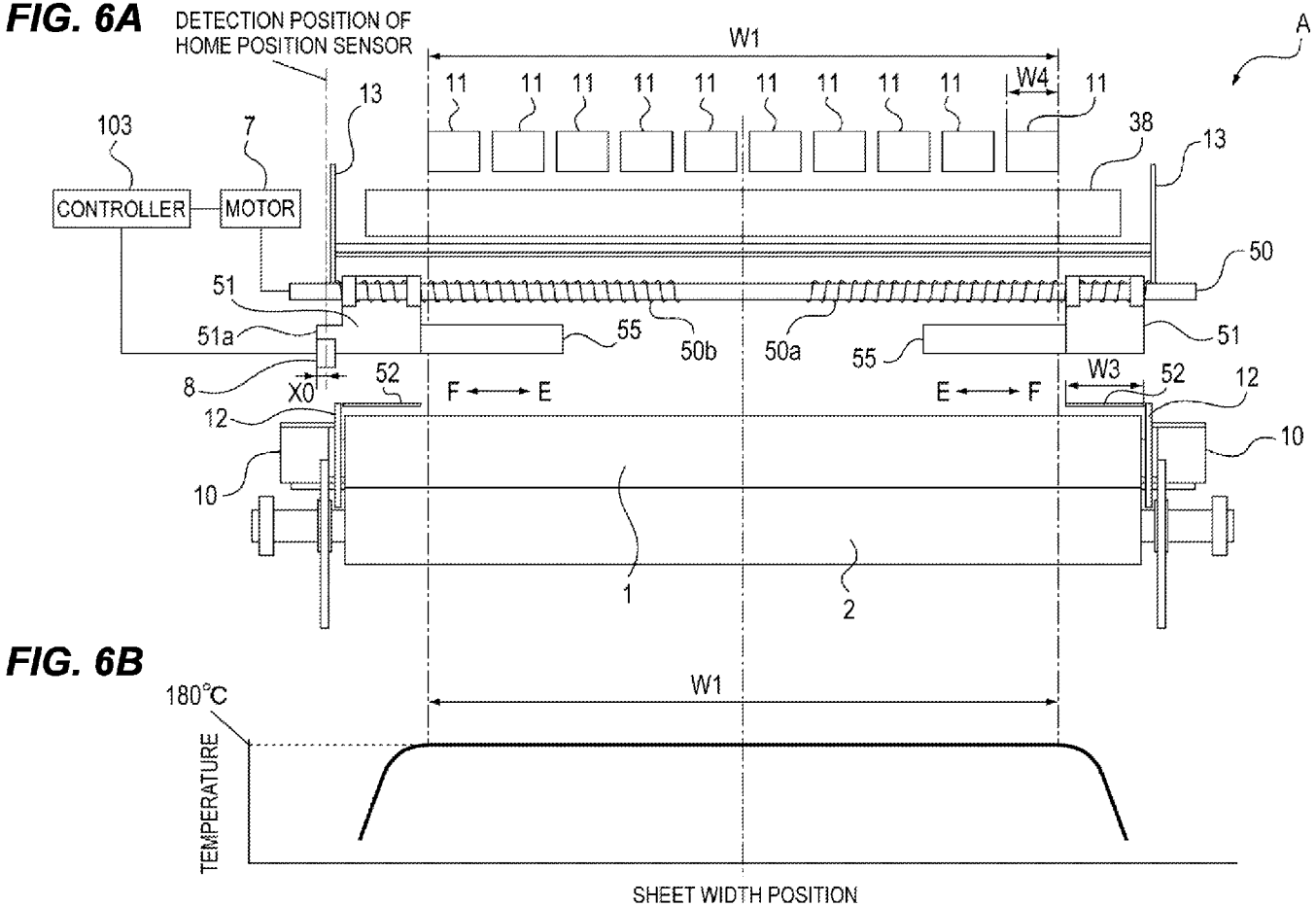
FIG. 6A is a schematic illustration diagram illustrating a configuration of the fixing apparatus according to the embodiment of the present invention.
FIG. 6B is a schematic illustration diagram illustrating a configuration of the fixing apparatus according to the embodiment of the present invention.
Figures 7A, 7B:
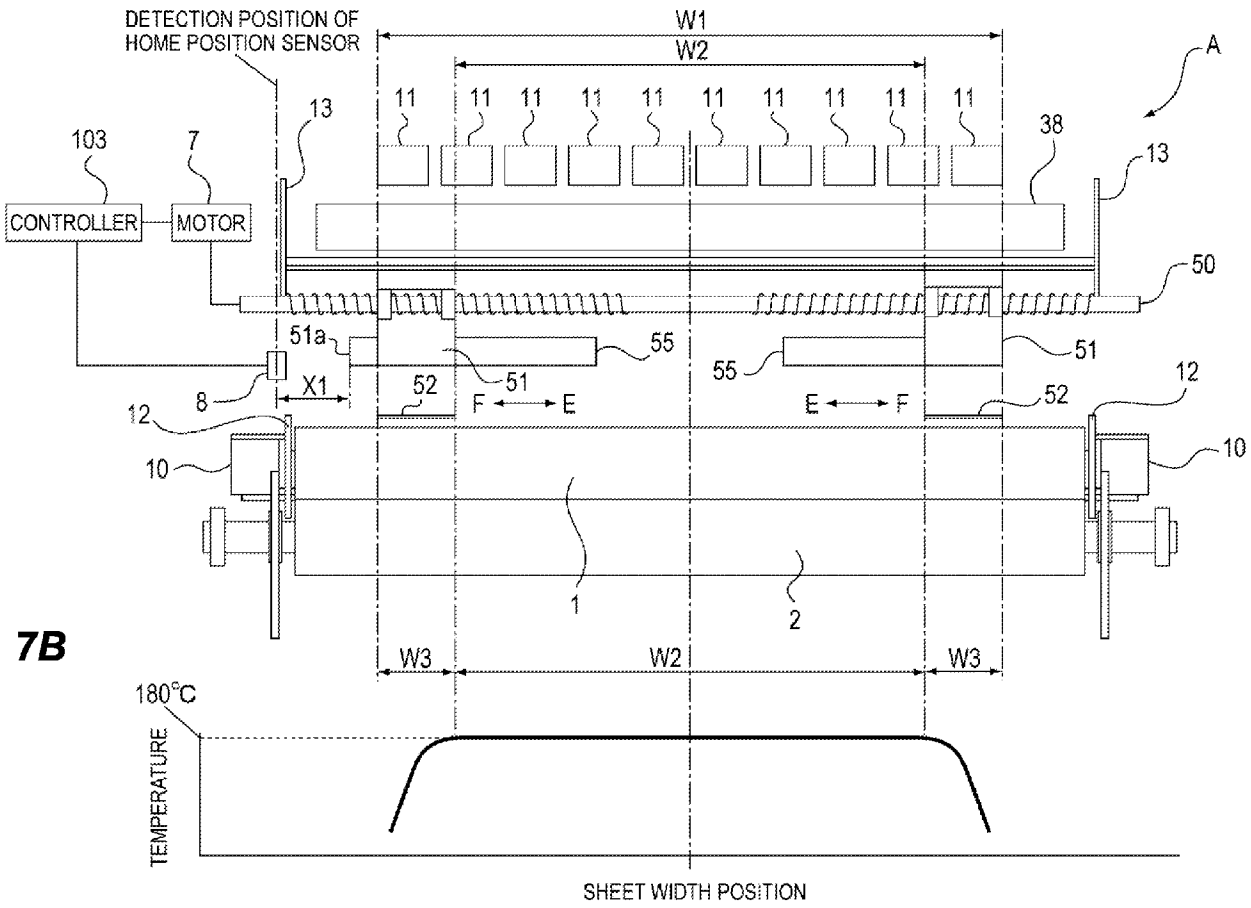
FIG. 7A is a schematic illustration diagram illustrating a configuration of the fixing apparatus according to the embodiment of the present invention.
FIG. 7B is a schematic illustration diagram illustrating a configuration of the fixing apparatus according to the embodiment of the present invention.
Figure 8:
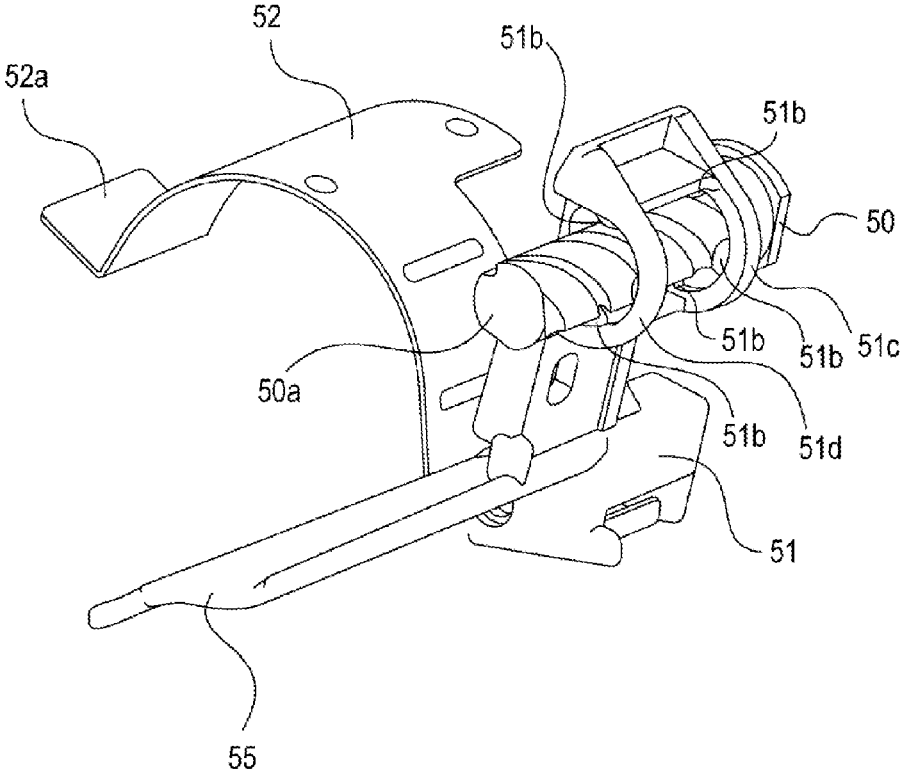
FIG. 8 is a perspective illustration diagram of essential parts illustrating a configuration of a moving portion which moves a slide member in which a magnetic flux shielding portion and a sheet guide member are integrally provided.

By moving the magnetic flux shielding member 52 in the longitudinal direction of the fixing apparatus A, as illustrated in FIGS. 6B and 7B, the heat generation distribution in the longitudinal direction of the fixing belt 1 is controlled according to the size of the sheet P.

The magnetic flux shielding members 52 are disposed at both ends of the fixing belt 1 in the longitudinal direction of the fixing apparatus A. A width W3 of the magnetic flux shielding members 52 disposed at both ends of the fixing belt 1 in the direction perpendicular to the sheet conveying direction (hereinafter, "width of the magnetic flux shielding member 52 in an axial direction") is as follows. That is, as illustrated in FIG. 6A, the width W3 is set to be a width which can be disposed between a support side plate 12 of the fixing belt 1 and an outermost end of the outer magnetic core 11 in the longitudinal direction.

The magnetic flux formed by the exciting coil 38 and the outer magnetic core 11 passes through the metal layer (conductive layer) provided in the base layer 1*a* of the fixing belt 1. In order to exhibit the effect that the magnetic flux is shielded by the magnetic flux shielding member 52, the width W3 of the magnetic flux shielding member 52 in the axial direction needs to be sufficiently wide. Also, the width W3 of the magnetic flux shielding member 52 in the axial direction needs to be sufficiently wide so that the maximum heat generation width of the fixing belt 1 does not reduce the sheet width W1 of the maximum size of the sheet P to be used. Also, the width W3 of the magnetic flux shielding member 52 in the axial direction needs to be wide enough to be disposed without expanding the width of the fixing apparatus A in the longitudinal direction.

In order to sufficiently exhibit the magnetic flux shielding effect by the magnetic flux shielding member 52, the width W3 of the magnetic flux shielding member 52 in the axial direction and the width W4 of the outer magnetic core 11 in the direction perpendicular to the sheet conveying direction are set to satisfy the relation of Math. 1 below. Also, hereinafter, the width of the outer magnetic core 11 in the direction perpendicular to the sheet conveying direction will be referred to as "width of the outer magnetic core 11 in the axial direction".

$$W3>W4 \qquad \text{[Math. 1]}$$

When the condition of Math. 1 is not satisfied, that is, when the width W3 of the magnetic flux shielding member 52 is smaller than the width W4 of the outer magnetic core 11 in the axial direction, the effect that reduces the temperature rise at the end of the sheet P in the width direction (horizontal direction of FIG. 6) is lowered. Therefore, the width W3 of the magnetic flux shielding member 52 is set to be larger than the width W4 of the outer magnetic core 11 in the axial direction.

As illustrated in FIG. 6A, the magnetic flux shielding member 52 is disposed outside the region of the sheet width W1 of the maximum size of the sheet P to be used. At this time, the magnetic flux shielding member 52 is disposed at a position outside the region where the outer magnetic core 11 and the fixing belt 1 face each other. Therefore, as illustrated in FIG. 6B, it is possible to secure the heat generation distribution corresponding to the sheet width W1 of the maximum size of the sheet P to be used. The position of the slide member 51 illustrated in FIG. 6A is set as an initial position (home position).

Next, a magnetic flux adjusting method by the magnetic flux shielding member 52 when the sheet of the minimum size (sheet width W2) is used will be described with reference to FIG. 7. The lead screw member 50 is rotated in a predetermined direction by rotating the motor 7 from the home position in a predetermined direction by the controller 103. Therefore, the pair of slide members 51 is moved to the center portion. That is, as the pair of slide members 51 is closer to each other, the pair of slide members 51 moves in a direction of an arrow E of FIG. 7A.

Therefore, the magnetic flux shielding members 52 provided in the slide members 51 also move in the direction of the arrow E of FIG. 7A. As illustrated in FIG. 7A, the magnetic flux shielding member 52 is disposed in a region where the outer magnetic core 11 and the fixing belt 1 face each other. This weakens the passing of the magnetic flux, which is formed by the exciting coil 38 and the outer magnetic core 11, through the metal layer (conductive layer) provided in the base layer 1*a* of the fixing belt 1. This reduces the induction heating of the metal layer (conductive layer) provided in the base layer 1*a* of the fixing belt 1.

As illustrated in FIG. 7A, the magnetic flux shielding member 52 is inserted into both ends of the fixing belt 1 in the longitudinal direction. This weakens the magnetic flux passing through the metal layer (conductive layer) provided in the base layer 1*a* of the fixing belt 1. Therefore, as illustrated in FIG. 7B, it is possible to form the heat generation distribution corresponding to the sheet width W2 of the minimum size of the sheet P.

<Moving Portion> Next, the configuration of the moving portion which moves the slide member 51 where the magnetic flux shielding member 52 and the sheet guide member 55 are integrally provided will be described.

As illustrated in FIGS. 2 and 8, the magnetic flux shielding member 52 is disposed between the fixing belt 1 and the exciting coil 38, and is held to the slide member 51 movably provided in the longitudinal direction of the fixing apparatus A.

The slide member 51 is movably supported along the lead screw member 50, such that the magnetic flux shielding member 52 and the sheet guide member 55 moving integrally with the slide member 51 in the longitudinal direction of the fixing apparatus A does not come into contact with the rotating fixing belt 1.

In the coil holding member 13, stopper portions 13*c* and 13*d* are disposed in parallel to the lead screw member 50 and are provided over the moving range of the pair of slide members 51. A leading end portion 52*a* of the magnetic flux shielding member 52 slidably abuts while being slidably fitted between the stopper portions 13*c* and 13*d* provided in the coil holding member 13. Therefore, the slide members 51 are movably supported along the lead screw member 50 in a stable posture. This can prevent the magnetic flux shielding member 52 from coming into contact with the fixing belt 1.

In the present embodiment, as illustrated in FIGS. 6 and 7, the slide members 51 holding the magnetic flux shielding member 52 and the sheet guide member 55 are symmetrically disposed at both ends of the fixing apparatus A in the longitudinal direction with respect to the center reference through which the sheet P passes.

As illustrated in FIG. 3, the lead screw member 50 is provided with the male screw portions 50*a* and 50*b* including a right-handed screw and a left-handed screw at one end and the other end, respectively. The lead screw member 50 is provided in parallel in the longitudinal direction of the coil holding member 13.

Axial end portions 50*c* and 50*d* at one end and the other end of the lead screw member 50 are axially supported rotatably to the bearing portions 13*a* and 13*b* provided at both ends of the coil holding member 13 in the longitudinal direction.

The magnetic flux shielding member 52 and the sheet guide member 55 are held by the pair of slide members 51, respectively. The slide members 51 are moved symmetrically to the center reference line (center of the sheet conveying path in the width direction), through which the sheet P passes, along the lead screw member 50 through the boss portions 51*b* respectively engaged with the male screw portions 50*a* and 50*b* of the lead screw member 50 driven to rotate by the motor 7.

For example, when the lead screw member 50 is rotated in a direction of an arrow G illustrated in FIG. 3, the pair of slide members 51 is moved in a direction of an arrow E illustrated in FIG. 3. Meanwhile, when the lead screw member 50 is rotated in a direction of an arrow H illustrated in FIG. 3, the pair of slide members 51 is moved in a direction of an arrow F illustrated in FIG. 3.

As illustrated in FIG. 8, cylindrical portions 51*c* and 51*d* respectively provided in the slide members 51 are fitted to the outside of the male screw portions 50*a* and 50*b* of the lead screw member 50. The boss portions 51*b* protruding on the inner circumferential surfaces of the cylindrical portions 51*c* and 51*d* are connected and engaged with the male screw portions 50*a* and 50*b*.

In the present embodiment, the boss portions 51*b* protruding on the inner circumferential surfaces of the cylindrical portions 51*c* and 51*d* fitted to the outside of the male screw portions 50*a* and 50*b* of the lead screw member 50 are configured to slidably contact the male screw portions 50*a* and 50*b* at three points so as to reduce the contact area with the male screw portions 50*a* and 50*b*. Also, the boss portions 51*b* may be configured to slidably contact the male screw portions 50*a* and 50*b* at more than three points.

Also, in the present embodiment, as the moving portion which moves the magnetic flux shielding member 52 and the sheet guide member 55 in the longitudinal direction of the fixing apparatus A, the use of the lead screw member 50 has been exemplified. In addition, a moving portion using a wire or a rack gear may also be used herein as long as the moving portion is configured to symmetrically move the magnetic flux shielding member 52 with respect to the center reference line through which the sheet P passes.

<Movement of Magnetic Flux Shielding Member> Next, the moving operation of the magnetic flux shielding member 52 and the sheet guide member 55 with respect to the conveying region of the sheet P from the sheet width w1 of the maximum size to the sheet width W2 of the minimum size of the sheet P to be used will be described.

As illustrated in FIGS. 6A and 7A, the controller 103 which controls the operation of moving the slide members 51 is provided. The controller 103 rotates the motor 7 which rotates the lead screw member 50 in a predetermined direction. Also, a home position sensor 8 is provided as a position detection portion of the slide members 51. The controller 103 controls the operation of the motor 7, based on a detection signal of the home position sensor 8.

The home position sensor 8 of the present embodiment is configured by a photo interrupter. The home position sensor 8 is turned on/off by transmitting/blocking an optical path of the photo interrupter by a flag portion 51*a* provided in the slide member 51.

Considering driving unevenness such as backlash caused by allowance between tooth surfaces of a gear train when the driving is transmitted from the motor 7 to the lead screw member 50, the home position sensor 8 detects an edge of the flag portion 51*a* and a position control of the slide members 51 is performed.

Figure 9:
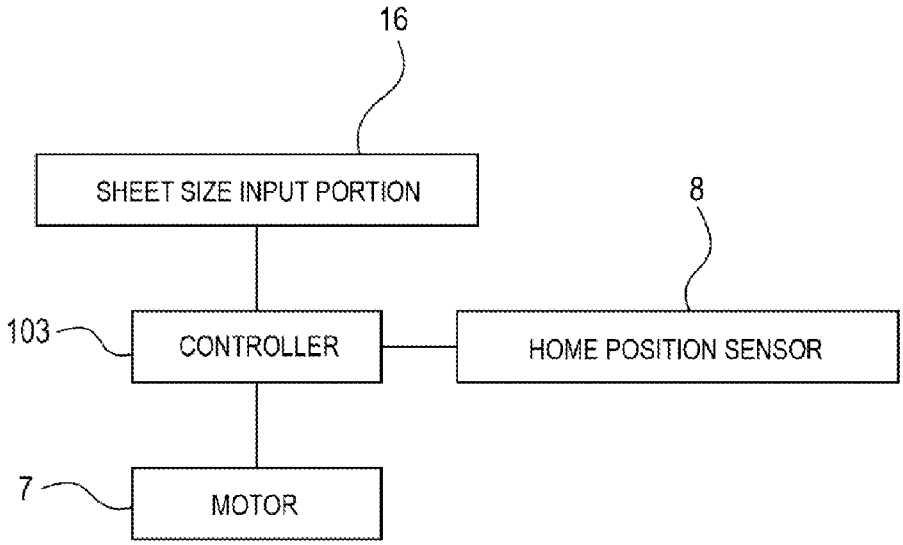
FIG. 9 is a block diagram illustrating a configuration of a control system of the moving portion which moves the slide member in which the magnetic flux shielding portion and the sheet guide member are integrally provided.
Figure 10:
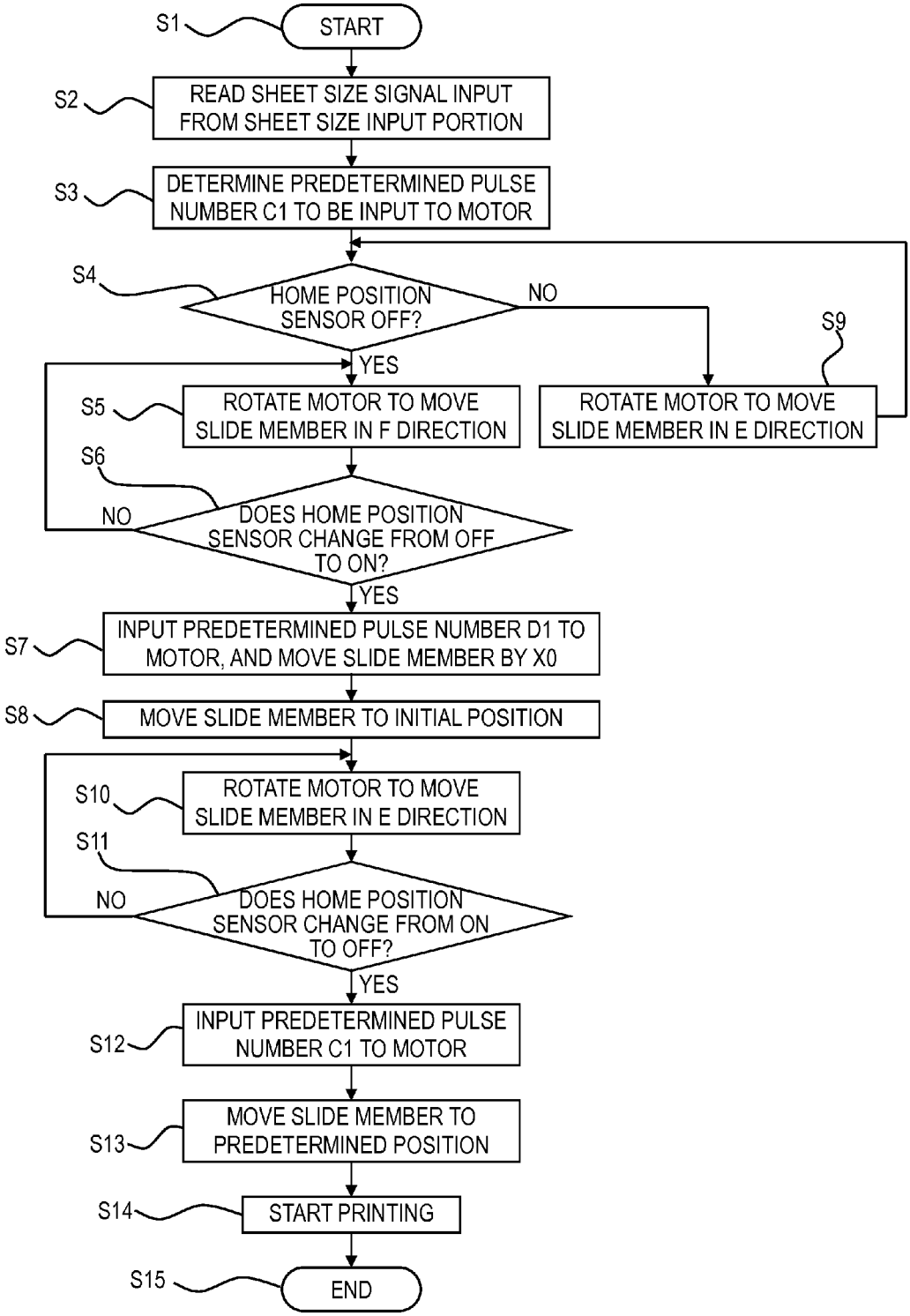
FIG. 10 is a flowchart illustrating an operation of moving the slide member, in which the magnetic flux shielding portion and the sheet guide member are integrally provided, by the moving portion in correspondence to a size width of a sheet in a direction perpendicular to a sheet conveying direction.

FIG. 9 is a block diagram illustrating a configuration of a control system of the moving portion which moves the slide member 51 in which the magnetic flux shielding member 52 and the sheet guide member 55 are integrally provided. FIG. 10 is a flowchart describing an operation of moving the slide member 51, in which the magnetic flux shielding member 52 and the sheet guide member 55 are integrally provided, by the moving portion in correspondence to the size width of the sheet P in the direction perpendicular to the sheet conveying direction.

As illustrated in FIG. 9, the controller 103 reads a size signal of the sheet P, which is input by a sheet size input portion 16 in a manipulation portion or a computer provided in the image forming apparatus, and controls the motor 7 based on the detection signal of the home position sensor 8.

An operation of moving the slide member 51 when the sheet P used has the sheet width W2 of the minimum size as illustrated in FIG. 7A will be described. First, in step S1 of FIG. 10, a print job is started. In step S2, the controller 103 reads the size signal of the sheet P used, which is input from the sheet size input portion 16 illustrated in FIG. 9.

In step S3, the controller 103 arithmetically operates and determines pulse number C1 input to the motor 7, so as to move the slide member 51 from an initial position illustrated in FIG. 6A by a predetermined distance according to the read size signal of the sheet P.

Subsequently, in steps S4 to S8, the controller 103 reads a detection signal of the home position sensor 8. The controller 103 controls the motor 7 such that the slide member 51 is returned to the initial position illustrated in FIG. 6A according to an ON/OFF state of the home position sensor 8.

First, in step S4, when the detection signal of the home position sensor 8 is in the OFF state, it is determined that the slide member 51 is not returned to the initial position illustrated in FIG. 6A, and is deviated toward the center portion in a direction perpendicular to a sheet conveying direction. Therefore, the process proceeds to step S5. In step S5, the controller 103 rotates the motor 7 to move the slide member 51 in a direction of an arrow F of FIG. 6A.

In step S6, after the flag portion 51*a* provided in the slide member 51 passes through a detection position of the home position sensor 8 and the detection signal of the home position sensor 8 changes from OFF to ON, the process proceeds to step S7. In step S7, the controller 103 performs control such that a predetermined pulse number D1 is input to the motor 7. Therefore, the operation of moving the slide member 51 is ended at a position moved by a distance X0 illustrated in FIG. 6A. In step S8, the slide member 51 is located at the initial position illustrated in FIG. 6A.

Meanwhile, when the detection signal of the home position sensor 8 is in the ON state in step S4, the process proceeds to step S9. In step S9, the controller 103 rotates the motor 7 to move the slide member 51 in a direction of an arrow E of FIG. 7A.

When the controller 103 recognizes that the detection signal of the home position sensor 8 has changed from ON to OFF in step S4, the process proceeds to step S5. In step S5, the controller 103 reversely rotates the motor 7 to move the slide member 51 in a direction of an arrow F of FIG. 7A.

Subsequently, in step S6, after the flag portion 51*a* provided in the slide member 51 passes through the detection position of the home position sensor 8 and the detection signal of the home position sensor 8 changes from OFF to ON, the process proceeds to step S7. In step S7, the controller 103 inputs a predetermined pulse number D1 to the motor 7. Therefore, the operation of moving the slide member 51 is ended at a position moved by a distance X0 illustrated in FIG. 6A. In step S8, the slide member 51 is located at the initial position illustrated in FIG. 6A.

Subsequently, in step S10, the controller 103 rotates the motor 7 to move the slide member 51 in a direction of an arrow E of FIG. 7A. In step S11, the flag portion 51*a* provided in the slide member 51 passes through the detection position of the home position sensor 8. After the detection signal of the home position sensor 8 changes from ON to OFF, the process proceeds to step S12. In step S12, the controller 103 inputs a predetermined pulse number C1 to the motor 7. Therefore, in step S13, the operation of moving the slide member 51 is ended at a position moved by a distance X1 illustrated in FIG. 7A. In step S14, a print is started.

Therefore, as illustrated in FIG. 7B, it is possible to form a heat generation distribution which does not cause a temperature rise in the non-passing region of the sheet P corresponding to the sheet width W2 of the minimum size of the sheet P to be used, or does not cause fixing failure at the end of the sheet P in the width direction.

Also, when using the usable maximum-size sheet (sheet width W1), the controller 103 sets "0" as the pulse number C1 input to the motor 7 in step S3. In this case, in step S14, the print is started without moving the slide member 51 from the initial position illustrated in FIG. 6A.

Also, the width $W_L$ of the longitudinal direction of the sheet P passing through the fixing apparatus A may have a value given in Math. 2 below, which is between the sheet width W1 of the maximum size and the sheet width W2 of the minimum size of the sheet P to be used.

$$W1>W_L>W2 \quad \text{[Math. 2]}$$

For the sheet P of the condition expressed in Math. 2 above, the response is as follows. That is, in step S3, the controller 103 moves the slide member 51 from the initial position illustrated in FIG. 6A by a predetermined distance in the sheet width direction according to the sheet size signal of the width $W_L$ of the sheet P in the longitudinal direction, which is read from the sheet size input portion 16. Therefore, the controller 103 changes the pulse number C1 input to the motor 7. As described above, it is possible to form a heat generation distribution which does not cause a temperature rise in the non-passing region of the sheet P corresponding to the width $W_L$ of the longitudinal direction of the sheet P to be used, or does not cause fixing failure at the sheet width end portion of the sheet P.

<Sheet Guide Member> Next, the sheet guide member 55 will be described with reference to FIGS. 2 and 8. As illustrated in FIG. 8, the sheet guide member 55 is provided integrally with the slide member 51. Therefore, the sheet guide member 55 is moved integrally with the slide member 51 along the lead screw member 50.

The sheet guide member 55 is a member which guides the sheet P conveyed toward the fixing apparatus A. The sheet guide member 55 is made of a metal or a resin. In order to improve the conveyance of the sheet P, fluorine coating having good sliding property may be performed on the sheet guide member 55, or a sheet having good sliding property may be attached to the sheet guide member 55. Also, the sheet guide member 55 may be configured to be detachable from the slide member 51 for the purpose of cleaning or replacement.

As illustrated in FIGS. 6A and 7A, the sheet guide member 55 is configured to be movable integrally with the slide member 51 in the region between the sheet width W1 of the maximum size and the sheet width W2 of the minimum size of the sheet P to be used.

The sheet guide member 55 is disposed at the sheet width end portion of the sheet P to be used. As illustrated in FIG. 6A, even when using the usable maximum-size sheet (sheet width W1), the sheet guide member 55 is moved integrally with the slide member 51. Also, as illustrated in FIG. 7A, even when using the usable minimum-size sheet (sheet width W2), the sheet guide member 55 is moved integrally with the slide member 51.

Therefore, even when the size of the sheet P to be used is any sheet width (size), the sheet guide member 55 is moved such that the sheet guide member 55 is disposed at the sheet width end portion of the sheet P.

As illustrated in FIG. 2, the sheet guide member 55 is disposed in the vicinity of the fixing nip portion N and is disposed in an upstream side of the fixing nip N in the sheet conveying direction, such that the sheet P can be conveyed from the upstream side in the conveying direction of the sheet P (right side of FIG. 2) to the fixing nip portion N.

Therefore, as illustrated in FIG. 2, when there is a curl in the leading end portion P1 of the sheet P, the curled leading end portion P1 of the sheet P is guided by the sheet guide member 55 and the sheet P is cramped to the fixing nip portion N from the leading end portion P1.

Therefore, even when a shape such as a curl exists in the leading end portion P1 of the sheet P, the leading end portion P1 of the sheet P is certainly guided and cramped to the fixing nip portion N. Hence, the unfixed toner image T formed on the sheet P can be fixed by the fixing apparatus A.

Also, the moving portion including the lead screw member 50 so as to move the slide member 51 which supports the magnetic flux shielding member 52 and the sheet guide member 55 has been exemplified. However, the moving portion which moves the slide member 51 is not limited to the use of the lead screw member 50. For example, a configuration using a pinion gear and a rack may be provided for sliding the slide member 51 by the rotation from the motor 7. In this case, the pinion gear is rotated by the driving from the motor 7. The rack engaged with the pinion gear is provided in the slide member 51. The slide member 51 is slid by rotating the pinion gear by the driving from the motor 7.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-193668, filed Sep. 4, 2012, which is hereby incorporated by reference herein in its entirety.

What is claimed is:

1. A fixing apparatus which fixes a toner image on a sheet by heating the toner formed an the sheet, the fixing apparatus comprising:

a fixing portion which fixes a toner image op the sheet with heat;

a magnetic flux generating portion which generates a magnetic flux so as to heat the fixing portion;

a magnetic flux shielding portion which shields a magnetic flux generated by the magnetic flux generating portion between the fixing portion and the magnetic flux generating portion;

a support portion which supports the magnetic flux shielding portion;

a moving portion which moves the support portion in a sheet-width direction perpendicular to a sheet conveying direction;

a controller which controls the moving portion so as to move the magnetic flux shielding portion to a position based on a sheet size in the sheet-width direction; and a sheet guide portion which is supported on the support portion and guides the sheet to the fixing portion.

2. The fixing apparatus according to claim 1, wherein the magnetic flux shielding portion is provided as a pair of magnetic flux shielding portions in the sheet-width direction.

3. The fixing apparatus according to claim 1, wherein the moving portion comprises a lead screw member, and a driving source which rotates the lead screw member, wherein a screw portion engaged with the lead screw member is provided in the support portion, and when the lead screw member is rotated by the driving source, the support portion is moved along the lead screw member in the sheet-width direction.

4. The fixing apparatus according to claim 1, wherein at least a part of the sheet guide portion that extends more inwardly towards the center of the sheet conveyance path than the magnetic flux shielding portion, guides the sheet.

5. The fixing apparatus according to claim 1, wherein the moving portion moves the support portion to a position where the sheet guide portion guides an end portion of the sheet in the sheet-width direction.

6. The fixing apparatus according to claim 1, wherein the moving portion moves the magnetic flux shielding portion between a position in the sheet-width direction that is outside of an area of a sheet of a maximum usable width, and a position in the sheet-width direction that is outside of an area of a sheet of a minimum usable width and is within the area of a sheet of the maximum usable width.

7. The fixing apparatus according to claim 6, wherein the sheet guide portion guides the sheet to the fixing portion even when the magnetic flux shielding portion is located at the position in the sheet-width direction that is outside of the area of a sheet of a maximum usable width, and the sheet guide portion guides the sheet to the fixing portion even when the magnetic flux shielding portion is located at the position in the sheet-width direction that is outside of the area of a sheet of a minimum usable width and is within the area of a sheet of a maximum usable width.

8. The fixing apparatus according to claim 1, wherein the controller controls the moving portion such that the magnetic flux shielding portion is located at a position in the sheet-width direction on that is outside of an area of the sheet.

9. An image forming apparatus, comprising:

an image forming portion which forms an unfixed toner image on a sheet; and the fixing apparatus of claim 1 which fixes the toner image formed on the sheet by the image forming portion.

10. The fixing apparatus according to claim 1, wherein the fixing portion comprises a belt which rotates and comprises a conductive layer.

11. The fixing apparatus according to claim 1, wherein the sheet guide portion is coated with fluorine.

12. The fixing apparatus according to claim 1, wherein the fixing portion comprises a conductive layer.

13. A fixing apparatus which fixes a toner image on a sheet, the fixing apparatus comprising:

a magnetic flux generating portion which generates a magnetic flux;

a fixing portion which generates heat by the magnetic flux generated by the magnetic flux generating portion and fixes a toner image on the sheet with the heat;

a magnetic flux confining portion which confines the magnetic flux directed toward the fixing portion from the magnetic flux generating portion;

a sheet guide portion which guides the sheet, and a moving portion which integrally moves the magnetic flux confining portion and the sheet guide portion in a sheet-width direction perpendicular to a sheet conveying direction.

14. The fixing apparatus according to claim 13, wherein the magnetic flux confining portion is provided as a pair of magnetic flux confining portions in the sheet-width direction.

15. The fixing apparatus according to claim 13, further comprising, a support portion provided with the magnetic flux confining portion and the sheet guide portion, wherein the moving portion comprises a lead screw member, and a driving source which rotates the lead screw member, wherein a screw portion engaged with the lead screw member is provided in the support portion, and wherein when the lead screw member is rotted by the driving source, the support portion is moved along the lead screw member in the sheet-width direction.

16. The fixing apparatus according to claim 13, wherein at least a part of the sheet guide portion that extends more inwardly towards the center of the sheet conveyance path than the magnetic flux confining portion, guides the sheet.

17. The fixing apparatus according to claim 13, wherein the moving portion moves the sheet guide portion to a position where the sheet guide portion guides an end portion of the sheet in the sheet-width direction.

18. The fixing apparatus according to claim 13, wherein the moving portion moves the magnetic flux confining portion between a position in the sheet-width direction that is outside of an area of a sheet of a maximum usable width, and a position in the sheet-width direction that is outside of an area of a sheet of a minimum usable width and is within the area of a sheet of the maximum usable width.

19. The fixing apparatus according to claim 18, wherein the sheet guide portion guides the sheet to the fixing portion even when the magnetic flux confining portion is located at the position in the sheet-width direction that is outside of the area of a sheet of a maximum usable width, and the sheet guide portion guides the sheet to the fixing portion even when the magnetic flux confining portion is located at the position in the sheet-width direction that is outside of the area of a sheet of a minimum usable width and is within the area of a sheet of a maximum, usable width.

20. The fixing apparatus according to claim 13, wherein the moving portion moves the magnetic flux confining Portion such that the magnetic flux confining portion is located at a position in the sheet-width direction that is outside of an area of the sheet.

21. The fixing apparatus according to claim 13, wherein the fixing portion comprises a belt which rotates and comprises a conductive layer.

22. The fixing apparatus according to claim 13, wherein the sheet guide portion is coated with fluorine.

23. The fixing apparatus according to claim 13, wherein the fixing portion comprises a conductive layer.

24. The fixing apparatus according to claim 13, wherein the molding portion moves the magnetic flux confining portion to a position based on a sheet size in the sheet-width direction.

* * * * *